US007275511B1

(12) United States Patent
Wright et al.

(10) Patent No.: US 7,275,511 B1
(45) Date of Patent: Oct. 2, 2007

(54) INTAKE MANIFOLD ASSEMBLY

(75) Inventors: Christopher C Wright, Howell, MI (US); Robert J. Moran, Ann Arbor, MI (US); Iain J. Read, Wixom, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/460,006

(22) Filed: Jul. 26, 2006

(51) Int. Cl.
*F02M 35/10* (2006.01)

(52) U.S. Cl. ..... 123/184.48; 123/54.4

(58) Field of Classification Search ..... 123/184.48, 123/184.21, 45 A, 55 AA, 51 AA, 197.4, 123/54.4, 54.7
See application file for complete search history.

(56) References Cited

U.S. PATENT DOCUMENTS 4,116,172 A * 9/1978 Lohr et al. ..... 123/54.7
4,305,351 A * 12/1981 Staerzl ..... 123/73 A
5,309,885 A * 5/1994 Rawlings et al. ..... 123/509
5,515,822 A * 5/1996 Kobayashi et al. .... 123/184.36
5,822,986 A * 10/1998 Higashide ..... 60/313
5,911,205 A * 6/1999 Gambardella ..... 123/184.35
6,199,369 B1 * 3/2001 Meyer ..... 60/39.6
6,397,802 B1 * 6/2002 Rutschmann et al. .... 123/90.15
6,553,954 B1 * 4/2003 Slonecker ..... 123/184.38
6,553,980 B1 * 4/2003 Nally et al. ..... 123/585
6,619,267 B1 * 9/2003 Pao ..... 123/481
6,640,543 B1 * 11/2003 Seal ..... 60/609
6,820,597 B1 * 11/2004 Cullen et al. ..... 123/520
6,874,463 B1 * 4/2005 Bolander et al. ..... 123/198 F
7,011,071 B1 * 3/2006 Decuir, Jr. ..... 123/317
7,059,289 B2 * 6/2006 Cunningham et al. . 123/184.47
7,178,504 B2 * 2/2007 Huhn et al. ..... 123/336
2002/0189592 A1 * 12/2002 Nishigaki ..... 123/481
2003/0019458 A1 * 1/2003 Huesges ..... 123/184.48
2004/0128117 A1 * 7/2004 Crandall et al. ..... 703/2
2006/0096581 A1 * 5/2006 Pauli et al. ..... 123/480
2007/0028867 A1 * 2/2007 Fuchs et al. ..... 123/55.2
2007/0034177 A1 * 2/2007 Yoshizaki ..... 123/54.7

* cited by examiner

*Primary Examiner*—Cheryl Tyler
*Assistant Examiner*—Katrina Harris

(57) ABSTRACT

An intake assembly is provided for a sequentially fired eight cylinder V-type internal combustion engine including a cylinder block having a first band of cylinders and a second bank of cylinders. The assembly includes first, second, third, and fourth intake plenums mounted with respect to the engine. The first bank of cylinders includes a first group of two cylinders that fire ninety crank angle degrees apart from each other and the second bank of cylinders includes a second group of two cylinders that fire ninety crank angle degrees apart from each other. The first and second intake plenums are operable to communicate intake air to a respective one cylinder of the first group of two cylinders. The third and fourth intake plenums are operable to communicate intake air to a respective one cylinder of the second group of two cylinders.

15 Claims, 1 Drawing Sheet

10
12
14
16
18
20
22
22A
22B
22C
24
26
28
30
32
34
36
38
40
42
44
46
48
1
2
3
4
5
6
7
8

INTAKE MANIFOLD ASSEMBLY

TECHNICAL FIELD

The present invention relates to an intake manifold assembly for an internal combustion engine having a cross-plane crankshaft.

BACKGROUND OF THE INVENTION

Internal combustion engines with eight cylinders arranged in a V-type configuration (two banks of four cylinders disposed at a generally ninety degree angle to each other) typically include a dual plane or cross-plane crankshaft. With a cross-plane crankshaft, each crank pin (of four) is positioned at a ninety degree angle from the previous, such that when viewed from one end of the crankshaft, along the longitudinal axis, the the crank pins form a cross shape. With a cross-plane crankshaft, a cylinder of the first band of cylinders shares a crank pin with a cylinder of the second bank of cylinders. The cross-plane crankshaft can achieve very good engine balance as a result of counterweights formed integrally with crankshaft. While the sequential firing of the cylinders is regular overall, the firing of each bank is not. Within the sequential firing order, two cylinders on each bank of cylinders will fire ninety crank angle degrees apart from one another, whereas all other cylinders on a respective bank fire at 180 crank angle degrees intervals.

With a boosted diesel engine, such as a turbo charged or supercharged engine, the second close firing cylinder of each bank tends to induct more intake air than the first close firing cylinder resulting in a greater amount of intake air trapped within the second close firing cylinder. As a result, at high intake air flow rates, the second close firing cylinder of each bank of cylinders will have comparatively higher peak in-cylinder pressures that may limit power output due to engine stress/fatigue constraints. Additionally, the remaining six cylinders, with comparatively low peak in-cylinder pressures, may operate below their power potential.

SUMMARY OF THE INVENTION

An intake assembly is provided for a sequentially fired eight cylinder V-type internal combustion engine including a cylinder block having a first bank of cylinders and a second bank of cylinders wherein the first bank of cylinders defines the first, third, fifth, and seventh cylinder positioned from a first end to a second end of the engine. The second bank of cylinders defines the second, fourth, sixth, and eighth cylinder positioned from the first end to the second end of the engine. The intake assembly includes first and second intake plenums mounted with respect to the engine. Each of the first and second intake plenums are operable to communicate intake air to at least one of the first, third, fifth, and seventh cylinders. Additionally, third and fourth intake plenums are mounted with respect to the engine. Each of the third and fourth intake plenums are operable to communicate the intake air to at least one of the second, fourth, sixth, and eighth cylinders. The first band of cylinders includes a first group of two cylinders that fire ninety crank angle degrees apart from each. The second bank of cylinders includes a second group of two cylinders that fire ninety crank angle degrees apart from each other. The first intake plenum is operable to communicate the intake air to one cylinder of the first group of two cylinders and the second intake plenum is operable to communicate the intake air to another cylinder of the first group of two cylinders. The third intake plenum is operable to communicate the intake air to one cylinder of the second group of two cylinders and the fourth intake plenum is operable to communicate the intake air to another cylinder of the second group of two cylinders.

The first, second, third, and fourth intake plenums may be mounted with respect to the engine in an outboard configuration. The intake assembly may further include an intake air duct and a first and second flow passage in downstream fluid communication with the intake air duct. First and second runner passages may be provided in downstream fluid communication with the first flow passage. The first and second runner passages may be provided in fluid communication with a respective one of the first and second intake plenums. Third and fourth runner passages may be provided in downstream fluid communication with the second flow passage. The third and fourth runner passages may be provided in fluid communication with a respective one of the third and fourth intake plenums. A compressor may be provided to pressurize the intake air. An internal combustion engine incorporating the disclosed intake assembly is also provided.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figures 1, 2, 3, 4:
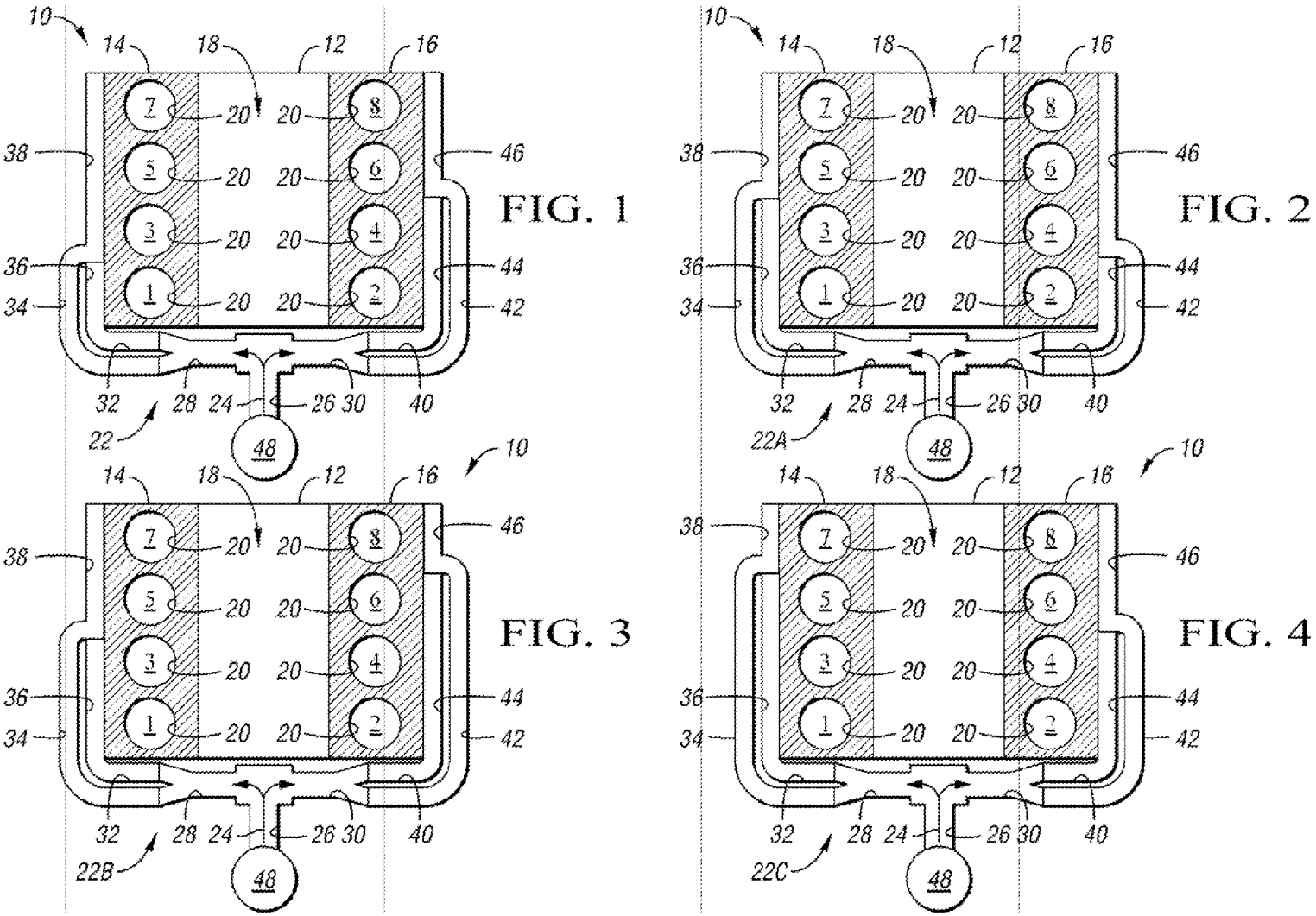
FIG. 1 is a schematic plan view of an eight cylinder, V-type internal combustion engine having a sequential firing order of 1-2-7-8-4-5-6-3 and illustrating an intake manifold assembly consistent with the present invention.
FIG. 2 is a schematic plan view of an eight cylinder, V-type internal combustion engine having a sequential firing order of 1-5-6-3-4-2-7-8 and illustrating an alternate embodiment of the intake manifold assembly of the present invention.
FIG. 3 is a schematic plan view of an eight cylinder, V-type internal combustion engine having a sequential firing order of 1-2-7-3-4-5-6-8 and illustrating an alternate embodiment of the intake manifold assembly of the present invention.
FIG. 4 is a schematic plan view of an eight cylinder, V-type internal combustion engine having a sequential firing order of 1-2-6-3-4-5-7-8 and illustrating an alternate embodiment of the intake manifold assembly of the present invention

Referring to the drawings wherein like reference numbers correspond to like or similar components throughout the several figures, there is shown in FIG. 1 an internal combustion engine 10. The internal combustion engine 10 may be either a spark-ignited type or a compression-ignited type. For discussion hereinbelow, it will be assumed that the internal combustion engine 10 is a compression-ignited internal combustion engine. The internal combustion engine 10 includes a cylinder case or block 12 having a first bank of cylinders 14 and a second bank of cylinders 16. The first and second bank of cylinders 14 and 16 are arranged in a generally V-shaped configuration such that the internal combustion engine 10 may be characterized as a V-type internal combustion engine. The space at least partially defined by the included angle of the first and second bank of cylinders 14 and 16 is generally referred to as a valley 18.

Each of the first and second bank of cylinders 14 and 16 define a plurality of cylinders 20. Each of the cylinders 20 defined by the first bank of cylinders 14 are arranged from a first end of the internal combustion engine 10 to a second end of the internal combustion engine 10 as first cylinder 1, third cylinder 3, fifth cylinder 5, and seventh cylinder 7. Similarly, each of the cylinders 20 defined by the second bank of cylinders 16 are arranged from the first end of the internal combustion engine 10 to the second end of the internal combustion engine 10 as second cylinder 2, fourth cylinder 4, sixth cylinder 6, and eighth cylinder 8. As such, the internal combustion engine 10 may be further characterized by having eight cylinders 20.

The internal combustion engine may further include an intake manifold assembly 22. The intake manifold assembly is operable to provide intake air 24 to the cylinders 20 of the internal combustion engine 10 to enable combustion of fuel, not shown, within the cylinders 20. The intake manifold assembly 22 includes an intake air duct 26 in fluid communication with a first flow passage and a second flow passage 28 and 30, respectively. The first flow passage 28 is in fluid communication with a first plenum runner 32 and a second plenum runner 34. The first plenum runner 32 is operable to communicate intake air 24 to a first plenum 36 for subsequent introduction to at least one of the first cylinder 1, third cylinder 3, fifth cylinder 5, and seventh cylinder 7. The second plenum runner 34 is operable to communicate intake air 24 to a second plenum 38 for subsequent introduction to the at least one of the first cylinder 1, third cylinder 3, fifth cylinder 5, and seventh cylinder 7 that is not in fluid communication with the first intake plenum 36.

The second flow passage 30 is in fluid communication with a third plenum runner 40 and a fourth plenum runner 42. The third plenum runner 40 is operable to communicate intake air 24 to a third plenum 44 for subsequent introduction to at least one of the second cylinder 2, fourth cylinder 4, sixth cylinder 6, and eighth cylinder 8. The fourth plenum runner 42 is operable to communicate intake air 24 to a fourth plenum 46 for subsequent introduction to the at least one of the second cylinder 2, fourth cylinder 4, sixth cylinder 6, and eighth cylinder 8 that is not in fluid communication with the third intake plenum 44.

As illustrated in FIG. 1, the first and second intake plenum 36 and 38 are mounted in an outboard position with respect to the internal combustion engine 10. That is, the first and second intake plenum 36 and 38 are disposed substantially adjacent to the first bank of cylinders 14 opposite the valley 18. Similarly, the third and fourth intake plenum 44 and 46 are mounted in an outboard position with respect to the internal combustion engine 10. That is, the third and fourth intake plenum 44 and 46 are disposed substantially adjacent to the second bank of cylinders 16 opposite the valley 18. A compressor 48, such as a turbocharger or a supercharger, may be provided in fluid communication with the intake manifold assembly 22, and operate to selectively pressurize the intake air 24 within the intake manifold assembly 22.

The intake manifold assembly 22 as shown in FIG. 1 is configured for a sequential cylinder firing sequence of the first cylinder 1, second cylinder 2, seventh cylinder 7, eighth cylinder 8, fourth cylinder 4, fifth cylinder 5, sixth cylinder 6, and third cylinder 3, or what is commonly referred to as a 1-2-7-8-4-5-6-3 firing order. With this configuration, the close firing pair of cylinders 20 on the first bank of cylinders 14 are the third cylinder 3 and the first cylinder 1. The first intake plenum 36 is configured to communicate intake air 24 to the first cylinder 1, and the second intake plenum 38 is configured to communicate intake air to the third cylinder 3, fifth cylinder 5, and seventh cylinder 7. The close firing pair of cylinders 20 on the second bank of cylinders 16 are the eighth cylinder 8 and the fourth cylinder 4. The third intake plenum 44 is configured to communicate intake air 24 to the second cylinder 2 and fourth cylinder 4, and the fourth intake plenum 46 is configured to communicate intake air to the sixth cylinder 6 and eighth cylinder 8. By configuring the intake manifold assembly 22 in this way, the tuning effects of the close firing pair of cylinders 20 on each of the first and second bank of cylinders 14 and 16 may be substantially attenuated.

Referring now to FIG. 2 there is shown the internal combustion engine 10 having an alternate embodiment of the intake manifold assembly 22, shown in FIG. 1, and generally indicated as 22A. The intake manifold assembly 22A is configured for a sequential cylinder firing sequence of the first cylinder 1, fifth cylinder 5, sixth cylinder 6, third cylinder 3, fourth cylinder 4, second cylinder 2, seventh cylinder 7, and eighth cylinder 8, or what is commonly referred to as a 1-5-6-3-4-2-7-8 firing order. With this configuration, the close firing pair of cylinders 20 on the first bank of cylinders 14 are the first cylinder 1 and the fifth cylinder 5. The first intake plenum 36 is configured to communicate intake air 24 to the first cylinder 1 and the third cylinder 3, and the second intake plenum 38 is configured to communicate intake air 24 to the fifth cylinder 5 and seventh cylinder 7. The close firing pair of cylinders 20 on the second bank of cylinders 16 are the fourth cylinder 4 and the second cylinder 2. The third intake plenum 44 is configured to communicate intake air 24 to the second cylinder 2, and the fourth intake plenum 46 is configured to communicate intake air 24 to the fourth cylinder 4, sixth cylinder 6, and eighth cylinder 8. By configuring the intake manifold assembly 22A in this way, the tuning effects of the close firing pair of cylinders 20 on each of the first and second bank of cylinders 14 and 16 may be substantially attenuated.

Referring now to FIG. 3 there is shown the internal combustion engine 10 having an alternate embodiment of the intake manifold assembly 22, shown in FIG. 1, and generally indicated as 22B. The intake manifold assembly 22B is configured for a sequential cylinder firing sequence of the first cylinder 1, second cylinder 2, seventh cylinder 7, third cylinder 3, fourth cylinder 4, fifth cylinder 5, sixth cylinder 6, and eighth cylinder 8, or what is commonly referred to as a 1-2-7-3-4-5-6-8 firing order. With this configuration, the close firing pair of cylinders 20 on the first bank of cylinders 14 are the seventh cylinder 7 and the third cylinder 3. The first intake plenum 36 is configured to communicate intake air 24 to the first cylinder 1 and the third cylinder 3, and the second intake plenum 38 is configured to communicate intake air 24 to the fifth cylinder 5 and seventh cylinder 7. The close firing pair of cylinders 20 on the second bank of cylinders 16 are the sixth cylinder 6 and the eighth cylinder 8. The third intake plenum 44 is configured to communicate intake air 24 to the fourth cylinder 4, sixth cylinder 6, and eighth cylinder 8, and the fourth intake plenum 46 is configured to communicate intake air 24 to the second cylinder 2. By configuring the intake manifold assembly 22B in this way, the tuning effects of the close firing pair of cylinders 20 on each of the first and second bank of cylinders 14 and 16 may be substantially attenuated.

Referring now to FIG. 4 there is shown the internal combustion engine 10 having an alternate embodiment of the intake manifold assembly 22, shown in FIG. 1, and generally indicated as 22C. The intake manifold assembly 22C is configured for a sequential cylinder firing sequence of the first cylinder 1, second cylinder 2, sixth cylinder 6, third cylinder 3, fourth cylinder 4, fifth cylinder 5, seventh cylinder 7, and eighty cylinder 8, or what is commonly referred to as a 1-2-6-3-4-5-7-8 firing order. With this configuration, the close firing pair of cylinders 20 on the first bank of cylinders 14 are the fifth cylinder 5 and the seventh cylinder 7. The first intake plenum 36 is configured to communicate intake air 24 to the first cylinder 1, third cylinder 3, and fifth cylinder 5, and the second intake plenum 38 is configured to communicate intake air 24 to the seventh cylinder 7. The close firing pair of cylinders 20 on the second bank of cylinders 16 are the second cylinder 2 and the sixth cylinder 6. The third intake plenum 44 is configured to communicate intake air 24 to the second cylinder 2 and fourth cylinder 4, and the fourth intake plenum 46 is configured to communicate intake air 24 to the sixth cylinder 6 and eighth cylinder 8. By configuring the intake manifold assembly 22C in this way, the tuning effects of the close firing pair of cylinders 20 on each of the first and second bank of cylinders 14 and 16 may be substantially attenuated.

By effectively separating the flow path of intake air 24 to the close firing pair of cylinders 20 on each of the first and second banks of cylinders 14 and 16, the cylinder-to-cylinder combustion variation of the internal combustion engine 10 may be substantially reduced. This reduction in variation may improve power density and exhaust emissions of the internal combustion engine 10.

While the best modes for carrying out the invention have been described in detail, those familiar with the art to which this invention relates will recognize various alternative designs and embodiment for practicing the invention within the scope of the appended claims.

The invention claimed is:

1. An intake assembly for a sequentially fired eight cylinder V-type internal combustion engine including a cylinder block having a first bank of cylinders and a second bank of cylinders wherein the first bank of cylinders defines the first, third, fifth, and seventh cylinder positioned sequentially from a first end to a second end of the engine and wherein the second bank of cylinders defines the second, fourth, sixth, and eighth cylinder positioned sequentially from the first end to the second end of the engine, the intake assembly comprising:

first and second intake plenums mounted with respect to the engine, wherein each of said first and second intake plenums are operable to communicate intake air to at least one of the first, third, fifth, and seventh cylinders;

third and fourth intake plenums mounted with respect to the engine, wherein each of said third and fourth intake plenums are operable to communicate said intake air to at least one of the second, fourth, sixth, and eighth cylinders;

wherein the first bank of cylinders includes a first group of two cylinders that fire ninety crank angle degrees apart from each other and wherein the second bank of cylinders includes a second group of two cylinders that fire ninety crank angle degrees apart from each other;

wherein said first intake plenum is operable to communicate said intake air to one cylinder of said first group of two cylinders and wherein said second intake plenum is operable to communicate said intake air to another cylinder of said first group of two cylinders;

wherein said third intake plenum is operable to communicate said intake air to one cylinder of said second group of two cylinders and wherein said fourth intake plenum is operable to communicate said intake air to another cylinder of said second group of two cylinders;

wherein the engine is configured according to one of the following:

A) wherein the engine sequentially fires the first cylinder, second cylinder, seventh cylinder, eighth cylinder, fourth cylinder, fifth cylinder, sixth cylinder, and third cylinder;

wherein said first intake plenum is operable to communicate said intake air to the first cylinder;

wherein said second intake plenum is operable to communicate said intake air to the third, fifth, and seventh cylinder;

wherein said third intake plenum is operable to communicate said intake air to the second and fourth cylinder; and wherein said fourth intake plenum is operable to communicate said intake air to the sixth and eighth cylinder;

B) wherein the engine sequentially fires the first cylinder, fifth cylinder, sixth cylinder, third cylinder, fourth cylinder, second cylinder, seventh cylinder, and eighth cylinder;

wherein said first intake plenum is operable to communicate said intake air to the first and third cylinder;

wherein said second intake plenum is operable to communicate said intake air to the fifth and seventh cylinder;

wherein said third intake plenum is operable to communicate said intake air to the second cylinder; and wherein said fourth intake plenum is operable to communicate said intake air to the fourth, sixth, and eighth cylinder;

C) wherein the engine sequentially fires the first cylinder, second cylinder, seventh cylinder, third cylinder, fourth cylinder, fifth cylinder, sixth cylinder, and eighty cylinder;

wherein said first intake plenum is operable to communicate said intake air to the first and third cylinder;

wherein said second intake plenum is operable to communicate said intake air to the fifth and seventh cylinder;

wherein said third intake plenum is operable to communicate said intake air to the second, fourth, sixth cylinder; and wherein said fourth intake plenum is operable to communicate said intake air to the eighth cylinder; and D) wherein the engine sequentially fires the first cylinder, second cylinder, sixth cylinder, third cylinder, fourth cylinder, fifth cylinder, seventh cylinder, and eighth cylinder;

wherein said first intake plenum is operable to communicate said intake air to the first, third, and fifth cylinder;

wherein said second intake plenum is operable to communicate said intake air to the seventh cylinder;

wherein said third intake plenum is operable to communicate said intake air to the second and fourth cylinder; and wherein said fourth intake plenum is operable to communicate said intake air to the sixth and eighth cylinder.

2. The intake assembly of claim 1, wherein said first and second intake plenums are mounted with respect to the engine in an outboard configuration and wherein said third and fourth intake plenums are mounted with respect to the engine in an outboard configuration.

3. The intake assembly of claim 1, further comprising:

an intake air duct;

a first flow passage in downstream fluid communication with said intake air duct;

a second flow passage in downstream fluid communication with said intake duct;

first and second runner passages in downstream fluid communication with said first flow passage, wherein said first and second runner passages are in fluid communication with a respective one of said first and second intake plenums; and third and fourth runner passages in downstream fluid communication with said second flow passage, wherein said third and fourth runner passages are in fluid communication with a respective one of said third and fourth intake plenums.

4. The intake assembly of claim 1, further comprising at least one compressor operable to pressurize said intake air.

5. A sequentially fired V-type internal combustion engine, comprising:

a cylinder block having a first bank of cylinders and a second bank of cylinders wherein said first bank of cylinders defines a first, third, fifth, and seventh cylinder positioned sequentially from a first end to a second end of the engine and wherein said second bank of cylinders defines the second, fourth, sixth, and eighth cylinder positioned sequentially from the first end to the second end of the engine;

first and second intake plenums mounted with respect to the engine, wherein each of said first and second intake plenums are operable to communicate intake air to at least one of said first, third, fifth, and seventh cylinders;

third and fourth intake plenums mounted with respect to the engine, wherein each of said third and fourth intake plenums are operable to communicate said intake air to at least one of said second, fourth, sixth, and eighth cylinders;

wherein said first bank of cylinders includes a first group of two cylinders that fire ninety crank angle degrees apart from each other and wherein said second bank of cylinders includes a second group of two cylinders that fire ninety crank angle degrees apart from each other;

wherein said first intake plenum is operable to communicate said intake air to one cylinder of said first group of two cylinders and wherein said second intake plenum is operable to communicate said intake air to another cylinder of said first group of two cylinders; and wherein said third intake plenum is operable to communicate said intake air to one cylinder of said second group of two cylinders and wherein said fourth intake plenum is operable to communicate said intake air to another cylinder of said second group of two cylinders.

6. The internal combustion engine of claim 5, wherein said first and second, third, and fourth intake plenums are mounted with respect to the engine in an outboard configuration.

7. The internal combustion engine of claim 5, further comprising:

an intake air duct;

a first flow passage in downstream fluid communication with said intake air duct;

a second flow passage in downstream fluid communication with said intake duct;

first and second runner passages in downstream fluid communication with said first flow passage, wherein said first and second runner passages are in fluid communication with a respective one of said first and second intake plenums; and third and fourth runner passages in downstream fluid communication with said second flow passage, wherein said third and fourth runner passages are in fluid communication with a respective one of said third and fourth intake plenums.

8. The internal combustion engine of claim 5, further comprising at least one compressor operable to pressurize said intake air.

9. The internal combustion engine of claim 5, wherein the engine sequentially fires said first cylinder, second cylinder, seventh cylinder, eighth cylinder, fourth cylinder, fifth cylinder, sixth cylinder, and third cylinder;

wherein said first intake plenum is operable to communicate said intake air to said first cylinder;

wherein said second intake plenum is operable to communicate said intake air to said third, fifth, and seventh cylinder;

wherein said third intake plenum is operable to communicate said intake air to said second and fourth cylinder; and wherein said fourth intake plenum is operable to communicate said intake air to said sixth and eighth cylinder.

10. The internal combustion engine of claim 5, wherein the engine sequentially fires said first cylinder, fifth cylinder, sixth cylinder, third cylinder, fourth cylinder, second cylinder, seventh cylinder, and eighth cylinder;

wherein said first intake plenum is operable to communicate said intake air to said first and third cylinder;

wherein said second intake plenum is operable to communicate said intake air to said fifth and seventh cylinder;

wherein said third intake plenum is operable to communicate said intake air to said second cylinder; and wherein said fourth intake plenum is operable to communicate said intake air to said fourth, sixth, and eighth cylinder.

11. The internal combustion engine of claim 5, wherein the engine sequentially fires said first cylinder, second cylinder, seventh cylinder, third cylinder, fourth cylinder, fifth cylinder, sixth cylinder, and eighth cylinder;

wherein said first intake plenum is operable to communicate said intake air to said first and third cylinder;

wherein said second intake plenum is operable to communicate said intake air to said fifth and seventh cylinder;

wherein said third intake plenum is operable to communicate said intake air to said second, fourth, sixth cylinder; and wherein said fourth intake plenum is operable to communicate said intake air to said eighth cylinder.

12. The internal combustion engine of claim 5, wherein the engine sequentially fires said first cylinder, second cylinder, sixth cylinder, third cylinder, fourth cylinder, fifth cylinder, seventh cylinder, and eighth cylinder;

wherein said first intake plenum is operable to communicate said intake air to said first, third, and fifth cylinder;

wherein said second intake plenum is operable to communicate said intake air to said seventh cylinder;

wherein said third intake plenum is operable to communicate said intake air to said second and fourth cylinder; and wherein said fourth intake plenum is operable to communicate said intake air to said sixth and eighth cylinder.

13. An intake assembly for a sequentially fired eight cylinder V-type internal combustion engine including a cylinder block having a first bank of cylinders and a second bank of cylinders wherein the first bank of cylinders defines the first, third, fifth, and seventh cylinder positioned sequentially from a first end to a second end of the engine and wherein the second bank of cylinders defines the second, fourth, sixth, and eighth cylinder positioned sequentially from the first end to the second end of the engine, the intake assembly comprising:

an intake air duct;

a first flow passage in downstream fluid communication with said intake air duct;

a second flow passage in downstream fluid communication with said intake duct;

first and second runner passages in downstream fluid communication with said first flow passage;

third and fourth runner passages in downstream fluid communication with said second flow passage;

first and second intake plenums mounted with respect to the engine, wherein each of said first and second intake plenums are operable to communicate intake air to at least one of the first, third, fifth, and seventh cylinders;

wherein said first and second runner passages are in fluid communication with a respective one of said first and second intake plenums;

third and fourth intake plenums mounted with respect to the engine, wherein each of said third and fourth intake plenums are operable to communicate said intake air to at least one of the second, fourth, sixth, and eighth cylinders;

wherein said third and fourth runner passages are in fluid communication with a respective one of said third and fourth intake plenums;

wherein the first bank of cylinders includes a first group of two cylinders that fire ninety crank angle degrees apart from each other and wherein the second bank of cylinders includes a second group of two cylinders that fire ninety crank angle degrees apart from each other;

wherein said first intake plenum is operable to communicate said intake air to one cylinder of said first group of two cylinders and wherein said second intake plenum is operable to communicate said intake air to another cylinder of said first group of two cylinders;

wherein said third intake plenum is operable to communicate said intake air to one cylinder of said second group of two cylinders and wherein said fourth intake plenum is operable to communicate said intake air to another cylinder of said second group of two cylinders;

wherein the engine sequentially fires the first cylinder, second cylinder, seventh cylinder, eighty cylinder, fourth cylinder, fifth cylinder, sixth cylinder, and third cylinder;

wherein said first intake plenum is operable to communicate said intake air to the first cylinder;

wherein said second intake plenum is operable to communicate said intake air to the third, fifth, and seventh cylinder;

wherein said third intake plenum is operable to communicate said intake air to the second and fourth cylinder; and wherein said fourth intake plenum is operable to communicate said intake air to the sixth and eighth cylinder.

14. The intake assembly of claim 13, further comprising at least one compressor operable to pressurize said intake air.

15. The intake assembly of claim 13, wherein said first and second intake plenums are mounted with respect to the engine in an outboard configuration and wherein said third and fourth intake plenums are mounted with respect to the engine in an outboard configuration.

* * * * *